US008016686B2

(12) United States Patent
Liggett et al.

(10) Patent No.: US 8,016,686 B2
(45) Date of Patent: Sep. 13, 2011

(54) RETRACTABLE CHALLENGE COURSE

(76) Inventors: James A. Liggett, Martin, MI (US); Troy Garland, Pullman, MI (US)

( * ) Notice: Subject to any disclaimer, the term of this patent is extended or adjusted under 35 U.S.C. 154(b) by 711 days.

(21) Appl. No.: 11/852,987

(22) Filed: Sep. 10, 2007

(65) Prior Publication Data

US 2009/0069104 A1 Mar. 12, 2009

(51) Int. Cl.
*A63G 31/00* (2006.01)
*F16M 13/02* (2006.01)

(52) U.S. Cl. ..... 472/136; 472/15; 472/49; 472/92; 182/36; 482/35; 248/327

(58) Field of Classification Search ..... 472/136, 472/15, 49, 92; 248/327; 182/36; 482/35
See application file for complete search history.

(56) References Cited

U.S. PATENT DOCUMENTS

| | | | | | |
|---|---|---|---|---|---|
| 2,365,117 | A * | 12/1944 | Stafford et al. | ..... | 482/37 |
| 3,211,452 | A * | 10/1965 | Ahrens | ..... | 482/35 |
| 3,563,539 | A * | 2/1971 | Rogers et al. | ..... | 482/37 |
| 4,737,107 | A * | 4/1988 | Bories et al. | ..... | 434/29 |
| 6,666,773 | B1 * | 12/2003 | Richardson | ..... | 472/49 |
| 7,175,534 | B2 * | 2/2007 | Liggett | ..... | 472/15 |
| 7,416,054 | B2 * | 8/2008 | Liggett | ..... | 182/36 |
| 7,614,957 | B2 * | 11/2009 | Lickle | ..... | 472/89 |
| 2006/0090960 | A1 * | 5/2006 | Liggett | ..... | 182/36 |
| 2006/0135272 | A1 * | 6/2006 | Liggett | ..... | 472/92 |
| 2009/0065300 | A1 * | 3/2009 | Liggett et al. | ..... | 182/36 |

* cited by examiner

*Primary Examiner* — Gene Kim
*Assistant Examiner* — Michael D Dennis
(74) *Attorney, Agent, or Firm* — Robert J. Sayfie

(57) ABSTRACT

A retractable challenge course having a support beam (15); an overhead tracking member (120) secured with respect to the support beam (15); a vertical support member (125) pivotally connected via a pivot aperture (220) to the support beam (15), the vertical support member (125) extending downwardly from the support beam (15) to support an element (40) disposed below the support beam (15).

4 Claims, 5 Drawing Sheets

RETRACTABLE CHALLENGE COURSE

FIELD OF THE INVENTION

This invention relates to an apparatus in which participants are challenged to walk or scale various elements while elevated above the ground, which can test the participant's skills such as confidence or group problem solving.

BACKGROUND OF THE INVENTION

Challenge courses are structures that allow a person or team to challenge themselves by participating in various events such as walking along swinging ropes or planks, at elevated heights. These courses are also used to train military personnel. These courses are also used at recreational parks or other such centers that have go-carts and miniature golf.

The invention is a retractable challenge course that can be secured to a ceiling or similarly elevated structure. The retractable challenge course can be deployed or lowered when in use, and retracted, stowed, or raised when not in use.

There further exists a need for a retractable challenge course in which the participant is secured to the safety cable before reaching the activity height, such as at the ground level.

There further exists a need for a deployable and retractable challenge course. This enables an area, such as a gymnasium to be used for various purposes. For example, when the retractable challenge course is retracted, stowed, or raised, and if it is installed in a gymnasium, then the gym can be used for basketball games or volleyball games because more clearance may exist between the floor and the retraced challenge course, as opposed to when the challenge course is lowered or deployed. However when the retractable challenge course is deployed, or lowered, then the retractable challenge course may be used.

There also exists the need to increase the flow and capacity of participants to allow for increased traffic flow.

As can be seen, there is a need for a challenge course that is retractable and deployable.

Multiple embodiments of the system are disclosed herein. It will be understood that other objects and purposes of the invention, and variations thereof, will be apparent upon reading the following specification and inspecting the accompanying drawings.

REFERENCE NUMERALS LIST

10 retractable challenge course
15 support beam
20 support beam distal end
25 support beam proximal end
30 compression beam
35 platform
37 platform support structure
39 support structure pivot aperture
40 element
45 track entrance and exit
50 standing area
55 gate
60 cross beam
65 sandwich connection
70 sandwich connection top plate
75 sandwich connection fastener
80 sandwich connection bottom plate
85 sandwich connection connector plate
90 hanger assembly

95 hanger brace
100 hanger brace member
105 hanger lug
110 tracking member connection beam
115 ceiling securing members
117 upstanding flange
120 overhead tracking member
125 vertical support member
127 vertical support member upper end
129 vertical support member lower end
130 vertical support brace member
135 cable fixed end
140 cable
142 vertical support member bar
144 bar flange
150 cage hanger
160 cage hanger top portion
162 cage hanger top portion plate
164 cage hanger web
170 cage hanger bottom portion
172 cage hanger bottom portion plate
180 fastener extension
190 fastener extension aperture
200 cage hanger top portion aperture
210 element aperture
220 pivot aperture
230 lock aperture
240 stopper
250 cage hanger pivot mechanism
252 cage hanger pivot aperture

SUMMARY OF THE INVENTION

A first aspect of the present invention is a retractable challenge course comprising: a support beam (15); an overhead tracking member (120) secured with respect to said support beam (15); a vertical support member (125) pivotally connected via a pivot aperture (220) to said support beam (15), said vertical support member (125) extending downwardly from said support beam (15) to support an element (40) disposed below said support beam (15), whereby said vertical support member (125) is capable of pivoting about the pivot aperture (220) so that the vertical support member (125) can be retracted and deployed.

Another aspect of the present invention is a retractable challenge course, comprising: a support beam (15); a cross beam (60) secured to said support beam (15), said cross beam (60) oriented substantially perpendicular with respect to said support beam (15); a tracking member connection beam (110) secured to said cross beam (60) and said support beam (15), a overhead tracking member (120) secured to said tracking member connection beam (110), said overhead tracking member disposed under said tracking member connection beam (110), said overhead tracking member (120) capable of movably receiving a part therein; a cage hanger (150) having a cage hanger top portion (160) that is secured to said support beam (15), said cage hanger also having a cage hanger bottom portion (170), said cage hanger bottom portion (170) having an element aperture (210) a pivot aperture (220), a lock aperture (230) and a stopper (240); a vertical support member (125) that is pivotally connected to said cage hanger (150) via said pivot aperture (220), said vertical support member (125) having a cage hanger pivot aperture (252); and a platform (35) that is supported by four vertical support members (125); said platform (35) having a platform support structure (37) extending downwardly from said platform (35), said platform support structure (37) having a support structure pivot aperture (39), said support structure pivot aperture (39) pivotally receiving a support structure-member fastener therethrough, said cage hanger pivot aperture (250) also pivotally receiving said support structure-member fastener therethrough, said platform support structure (37) having a bar flange (144) extending outwardly therefrom, said bar flange (144) having a vertical support member bar (142) rotatably received therein, said vertical support member bar (142) capable of being connected to at least one of a cable, a cord, a rope, or a spring; whereby said vertical support bar (142) may be displaced, which causes the vertical support members (125) to pivot about the pivot aperture (220), and retract and deploy the retractable challenge course (10); whereby said vertical support member (125) can be locked in place after deployment via a pin that is disposed through said locking aperture (230) and said pin also being disposed through a corresponding hole in said vertical support member (125); whereby said stopper (240) is capable of stopping said vertical support member (125) from extending beyond a desired position.

Another aspect of the present invention is a method of deploying and retracting a retractable challenge course, comprising the steps of: securing a support beam (15) to a building; securing an overhead tracking member (120) with respect to said support beam (15); and pivotally securing a vertical support member (125) via a pivot aperture (220) to said support beam (15), said vertical support member (125) extending downwardly from said support beam (15) to support an element (40) disposed below said support beam (15), whereby said vertical support member (125) is capable of pivoting about the pivot aperture (220) so that the vertical support member (125) can be retracted and deployed.

These and other features, aspects and advantages of the present invention will become better understood with reference to the following drawings, description and claims.

DETAILED DESCRIPTION OF THE INVENTION

Figure 1:
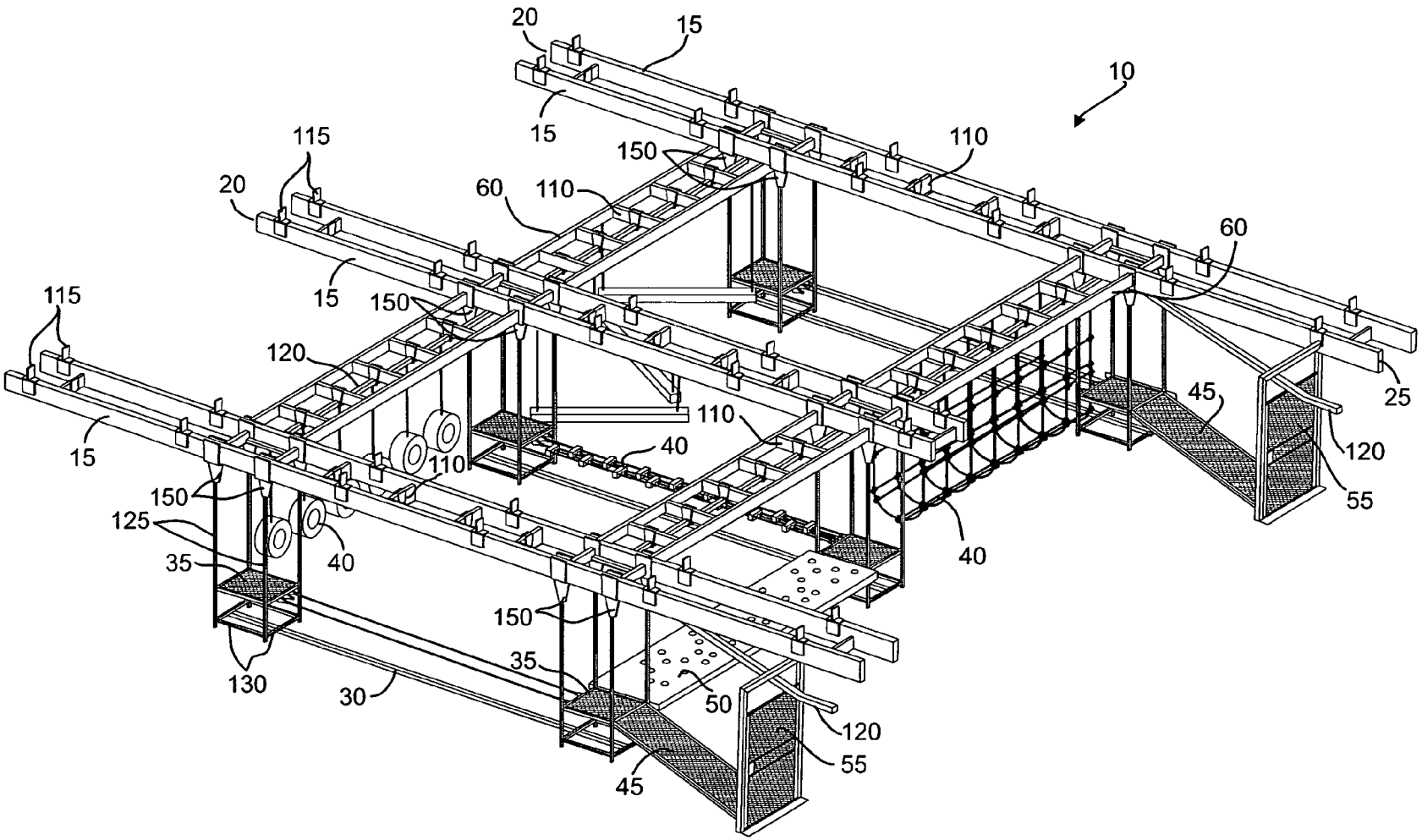
FIG. 1 is a pictorial view of one embodiment of the present invention in its deployed position.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words.

FIG. 1 illustrates one embodiment of the present invention. The retractable challenge course 10 may have support beams 15 that may secure the retractable challenge course 10 to a building, building structure, or ceiling (not illustrated). The support beam 15 may have a support beam proximal end 25, and an opposed support beam distal end 20. A ceiling securing member 115 may be secured to a support beam 15 and may have an upstanding flange 117 that may be welded to trusses above to secure the support beams 15 relative to the ceiling. A cross beam 60 may be secured to the support beam 15. The cross beam 60 may be disposed substantially perpendicular with respect to the support beam 15.

Figure 5:
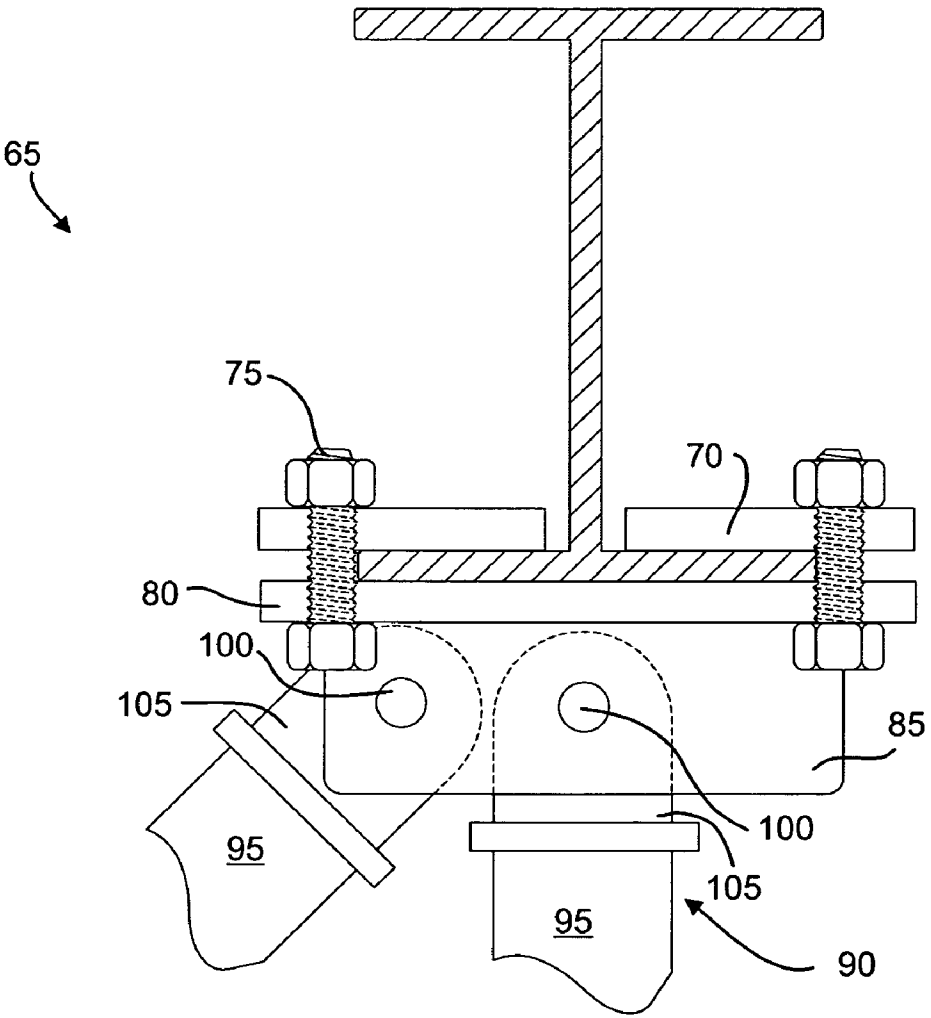
FIG. 5 illustrates one embodiment of a sandwich connection, which may secure the retractable challenge course to a ceiling or building structure.

In one embodiment, as illustrated in FIG. 5, the retractable challenge course 10 may be secured to an I-beam by a sandwich connection 65. The sandwich connection 65 may have a sandwich connection top plate 70 that is disposed above one flange of the I-beam. The sandwich connection bottom plate 80 is disposed underneath the respective I-beam flange and may be secured to the sandwich connection top plate 70 by a fastener. A sandwich connection connector plate 85 may extend downwardly from the sandwich connection bottom plate 80. The sandwich connection connector plate 85 may be capable of receiving a fastener 100 to secure a hanger lug 105 thereto. A hanger brace 95 may be secured to the sandwich connection 65 via the fastener 100.

Figure 6:
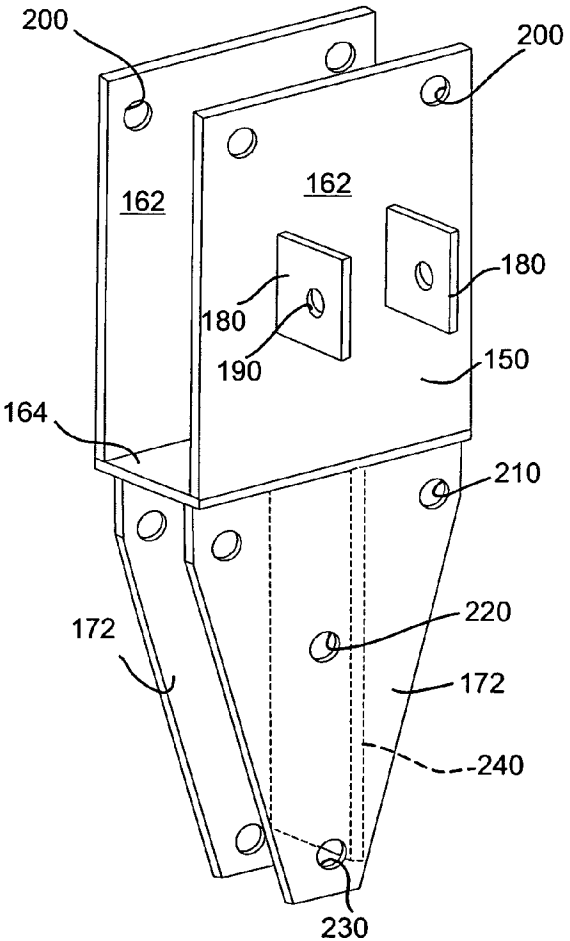
FIG. 6 illustrates a cage hanger.

A vertical support member 125 may be hingedly secured to the support beam 15 to enable the vertical support member 125 to pivot about a pivot means, such as the cage hanger 150 as illustrated in FIG. 6. FIG. 1 further illustrates platforms 35 that may be secured to the vertical support members 125. The vertical support member 125 may have a vertical support brace member 130 connected to adjacent vertical support members 125. FIG. 1 illustrates one embodiment of the present invention in which four vertical support members 125 may be used to support one platform 35, and four vertical support brace members 130 may be connected to each vertical support member 125.

Tracking member connection beams 110 may be disposed to the support beam 15 or the cross beam 60. An overhead tracking member 120, also referred to herein as a tracking member, 120 may be secured to the tracking member connection beam 110, and disposed between the cross beams 60 or support beams 15. Elements 40 may be disposed below the tracking member 120. Retractable challenge course participants may then traverse the element 40 in an effort to challenge themselves, physically and mentally, as well as in a variety of team exercises that can be employed. The tracking member 120 may be the type as disclosed is U.S. Patent Publication No. 2006/0090960 ("the 960 publication"); which is described in the abstract as "[a]n apparatus and method of traversing across elements of a challenge course by use of a tracking system that can continuously retain the harness cable that descends to the participant, as the moveable member moves in a substantially horizontal direction along the safety cables, or along the tracks of the moveable member exchange frame."

As illustrated in FIG. 1, the tracking member 120 may be disposed above the elements 40, and other areas that the participant may traverse. The tracking member 120 may movably retain or movably hold a safety cable therein, to secure the participant via cables, belts, or a safety harness, as described in the 960 publication.

A track entrance-exit 45 may be connected to the platform 35. In one embodiment of the present invention the track entrance-exit 45 may be a ramp-like structure, and a participant may have to walk upwardly on the track entrance-exit 45 to reach the platform 35. In a further embodiment, a participant may walk downwardly on the track entrance-exit 45 to the platform 35. In a further embodiment, a participant may walk neither upwardly nor downwardly on the track entrance-exit 45. As illustrated in FIG. 1, the overhead tracking member 120 may be disposed above the track entrance-exit 45 at substantially the same angle as the track entrance-exit 45. In other words, the tracking member 120 may be substantially parallel with the track entrance-exit 45 so that participant maintains about the same distance from the tracking member 120.

Figure 3:
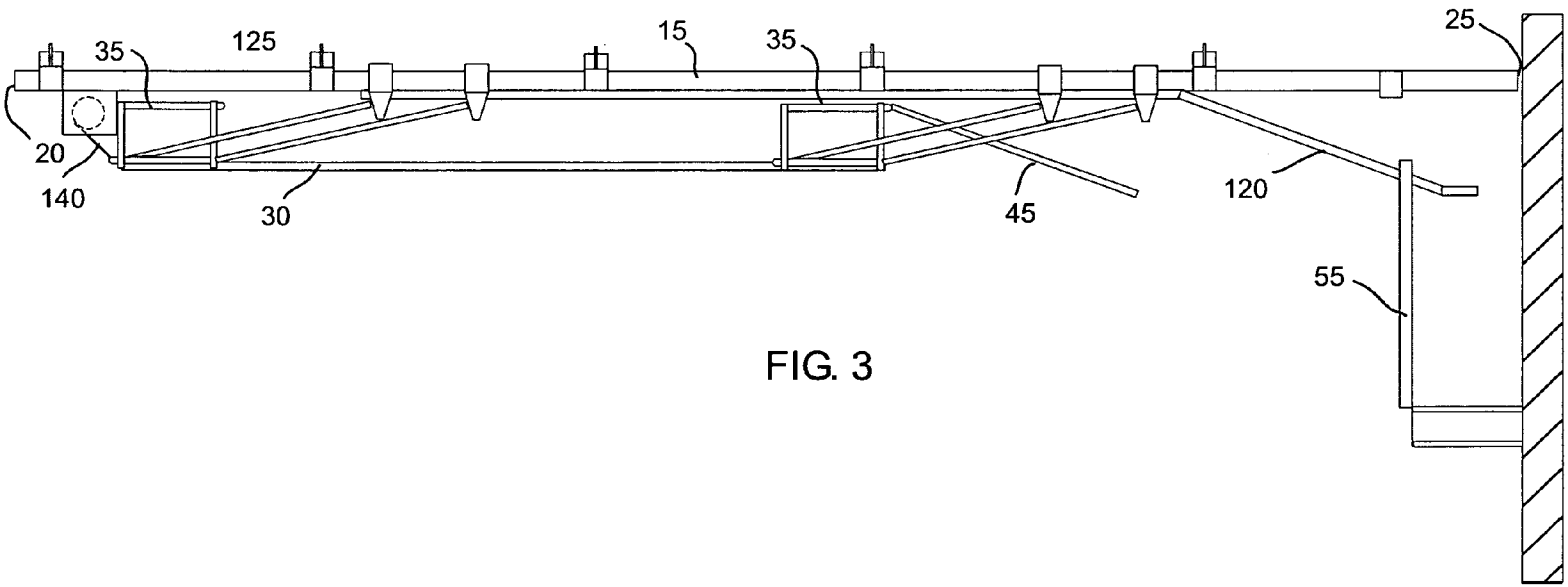
FIG. 3 is a side view of one embodiment of the present invention in its retracted position.

As illustrated in FIG. 3, the support beam 15 may remain fixed with respect to the ceiling, building structure, or building when the retractable challenge course 10 is raised, or in its stowed position. The vertical support member 125 may pivot at a point near the vertical support member's 125 connection with the support beam 15, as illustrated in FIG. 6, discussed below. The vertical support member 125 may also pivot as disclosed in FIG. 7, about pivot mechanism 250. The cable fixed end 135 may be secured to a vertical support member bar 142. The vertical support member bar 142 may be rotatably disposed to the vertical support member lower end 129. The compression beam 30 may connect one platform vertical support brace member 130 to another vertical support brace member 130. In one exemplary embodiment, the compression beam 30 may be connected to adjacent vertical support brace members 130.

A displaceable cable fixed end 135 may be secured to a vertical support brace member 130. An opposed end of the cable 140 may be connected to a winch, which enables the cable 140 to be displaced. In one embodiment, three separate winches may be used to displace three separate cables 140. In one embodiment, one motor or winch may be used to rotate a bar, where the bar can wind and unwind the cable 140, which may be connected to the vertical support member bar 142 to deploy or retract the retractable challenge course 10.

Figure 2:
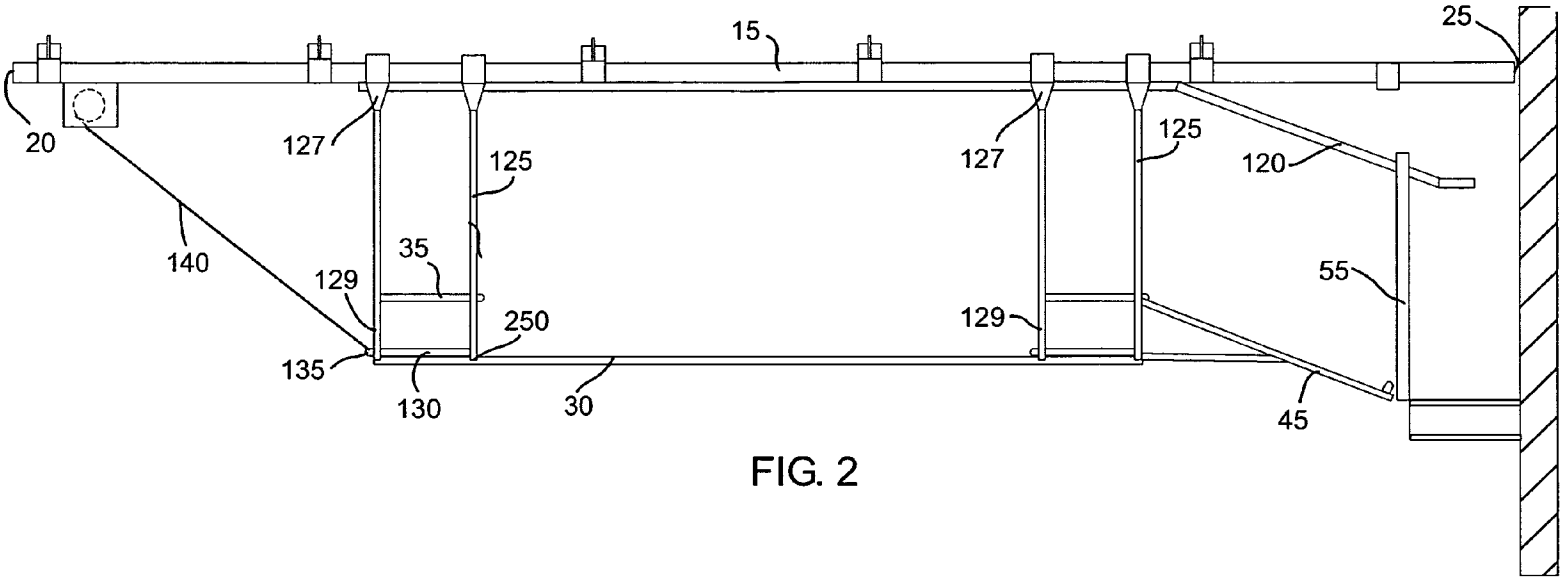
FIG. 2 is a side view of one embodiment of the present invention in its deployed position.

In one embodiment, to deploy the retractable challenge course 10 from a stowed position, as illustrated in FIG. 3, the winch is released, which allows the vertical support member 125 to swing downwardly until it is oriented substantially vertical, as shown in FIG. 2. When the vertical support member 125 is swung downwardly, the platform 35, vertical support brace member 130, and the compression beam 30 may descend in unison with the vertical support member 125. The vertical support member 125 may pivot at its upper end 127 with the vertical support member's intersection with the support beam 15. FIG. 6 illustrates a cage hanger 150 that has a pivot aperture 220. The pivot aperture 220 is capable of receiving a fastener that also goes through a corresponding hole in the upper end 127. The vertical support member 125 may pivot at its lower end 129 with the vertical support brace member 130.

Figure 7:
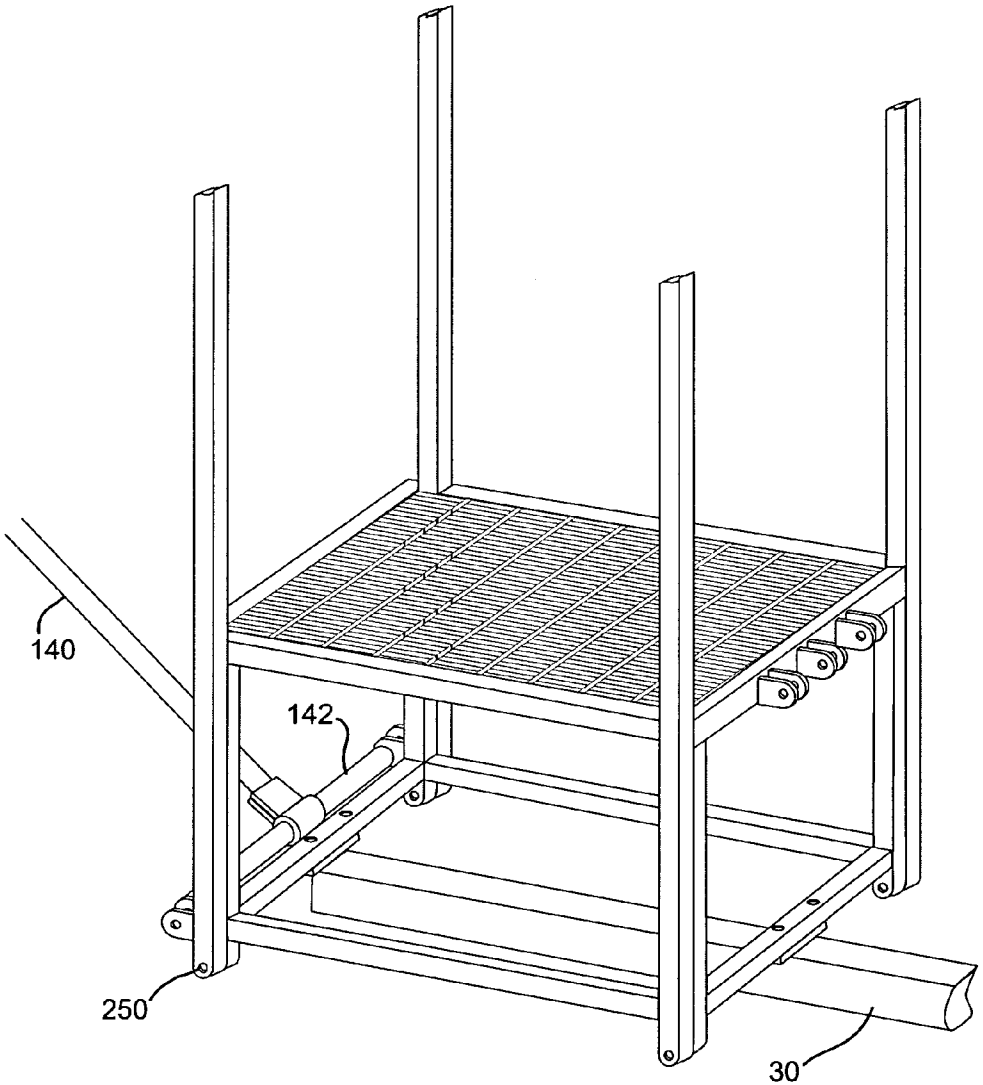
FIG. 7 illustrates the pivoting mechanism of the vertical support member.

FIG. 7 illustrates one embodiment as to how the cable fixed end 135 may be connected to a vertical support member bar 142; and also the pivoting arrangement 250, also referred to as the cage hanger pivot mechanism 250. The compression beam 30 may be secured to the vertical support brace member 130 to pivot about the cage hanger pivot mechanism 250 during deployment and retraction. The platform 35, and support beam 30 may remain substantially horizontal at all times, even during deployment and retraction, as well as when in the stowed position as illustrated in FIG. 3, and in its deployed position as illustrated in FIG. 2.

FIG. 1 illustrates an embodiment wherein one platform 35 may be supported by four vertical support members 125; wherein each of the vertical support members 125 pivotally extend downwardly from a cage hanger 150.

Figure 4:
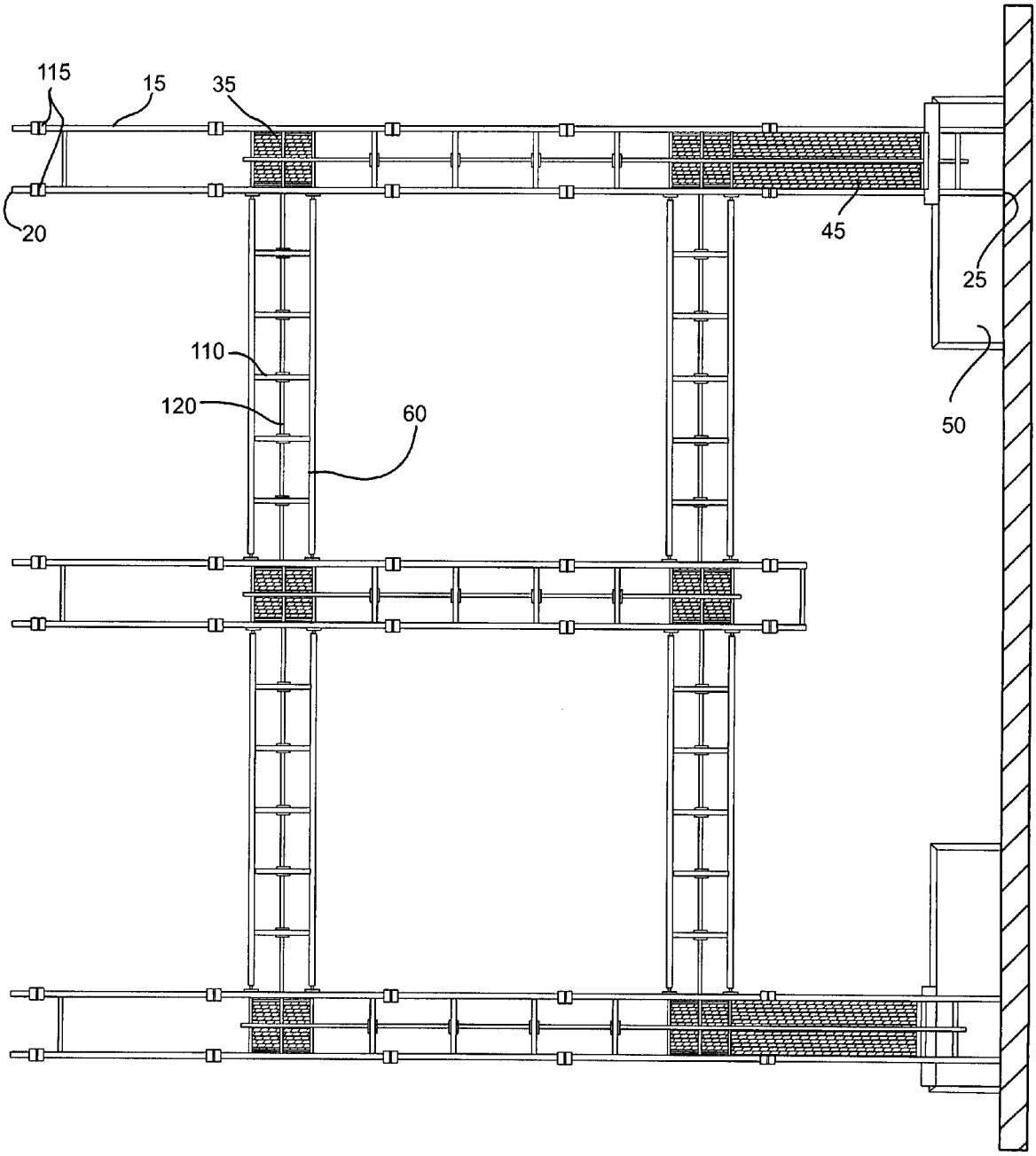
FIG. 4 is a top view of one embodiment of the present invention in its deployed position.

As further illustrated in FIG. 1, there may be two platforms 35 per one pair of support beams 15. Between these two platforms 35 may be a compression beam 30. The compression beam 30 enables a platform 35 to move in unison with another platform 35 along the same pair of support beams 15 when the retractable challenge course 10 is being retracted or deployed. As illustrated in FIG. 4, a cable, also referred to herein as a displaceable cable 140 may have a displaceable cable fixed end 135 that may be connected to a platform 35, to move the platform up and down. Thus if the compression beam 30 is fixed at one end to a first platform 35 to which the cable 140 is connected, then the other end of the compression beam 30 may be fixed to a second platform 35. This would cause the platforms 35 to move in unison during deployment or retraction. FIG. 1 illustrates two platforms 35 that would move in unison, however more than two platforms 35 may be disposed along a pair of support beams 15. For example, if three platforms 35 and associated vertical support members 125 were disposed along a pair of support beams 15, then two compression beams 30 may be used to connect the three platforms 35.

FIG. 6 illustrates a cage hanger 150, having a cage hanger top portion 160, and a cage hanger bottom portion 170. The cage hanger top portion 160 has a cage hanger top portion plate 162. A cage hanger web 164 is secured between adjacent cage hanger top portion plates 162, and an edge near the cage hanger bottom portion 170. A support beam 15 may be secured to the cage hanger top portion 160 by being received between two adjacent cage hanger top portion plates 162. The cage hanger top portion 160 may have a cage hanger top portion aperture 200 to receive fasteners therethrough; which may be secured to, through or above the support beam 15 to securely position the cage hanger 150 to the support beam.

The cage hanger bottom portion 170 has a cage hanger bottom portion plate 172. The cage hanger bottom portion plate 172 may be secured to the cage hanger web 164, so that a vertical support member 125 may be pivotally secured to a pivot aperture 220 of the cage hanger bottom portion plate 172. The cage hanger bottom portion plate 172 may have an element aperture 210 to receive ropes or cables or other fasteners to hang an element 40 therefrom. The cage hanger bottom portion plate 172 may have a lock aperture 230, to place a locking pin through so that the locking pin also enters an aperture on the vertical support member 125 to lock the vertical support member 125 in place when the retractable challenge course 10 is deployed. In another embodiment, more than two platforms 35 may be disposed along a pair of support beams 15.

It should be understood, of course, that the foregoing relates to exemplary embodiments of the invention and that modifications may be made without departing from the spirit and scope of the invention as set forth in the following claims.

We claim:

1. A retractable challenge course comprising: a support beam (15); an overhead tracking member (120) secured with respect to said support beam (15); a vertical support member (125) pivotally connected via a pivot aperture (220) to said support beam (15), said vertical support member (125) extending downwardly from said support beam (15) to support an element (40) disposed below said support beam (15), whereby said vertical support member (125) is capable of pivoting about the pivot aperture (220) so that the vertical support member (125) can be retracted and deployed; further comprising: a cross beam (60) secured to said support beam (15); said overhead tracking member (120) secured with respect to said support beam (15); a vertical support member (125) pivotally connected via a pivot aperture (220) to said cross beam (60), said vertical support member (125) extending downwardly from said cross beam (60) to support an element (40) disposed below said cross beam (60), whereby said vertical support member (125) is capable of pivoting about the pivot aperture (220) so that the vertical support member (125) can be retracted and deployed; further comprising: a tracking member connection beam (110) secured to at least one of said cross beam (60) or said support beam (15); said overhead tracking member (120) secured to said tracking member connection beam (110); a vertical support member (125) pivotally connected via a pivot aperture (220) to at least one of said cross beam (60), or said support beam; said vertical support member (125) extending downwardly from at least one of said cross beam (60) or said support beam (15) to support an element (40) disposed below said cross beam (60), whereby said vertical support member (125) is capable of pivoting about the pivot aperture (220) so that the vertical support member (125) can be retracted and deployed.

2. The apparatus of claim 1, further comprising:

a compression beam (30) secured to a vertical support brace member (130), whereby the compression beam (30) and vertical support brace member (130) are capable of retracting and deploying in unison, and a platform (35) and said compression beam (30) remain substantially parallel throughout the deployment and retracting process.

3. The apparatus of claim 1, further comprising:

a vertical support member bar (142) rotatably secured to a bar flange (142), said vertical support member bar (142) capable of being connected to at least one of a cable, a cord, or a rope;

whereby displacement of at least one of said cable, said core, or said rope, retracts and deploys the retractable challenge course (10).

4. A retractable challenge course, comprising:

a support beam (15);

a cross beam (60) secured to said support beam (15), said cross beam (60) oriented substantially perpendicular with respect to said support beam (15);

a tracking member connection beam (110) secured to said cross beam (60) and said support beam (15), a overhead tracking member (120) secured to said tracking member connection beam (110), said overhead tracking member disposed under said tracking member connection beam (110), said overhead tracking member (120) capable of movably receiving a part therein;

a cage hanger (150) having a cage hanger top portion (160) that is secured to said support beam (15), said cage hanger also having a cage hanger bottom portion (170), said cage hanger bottom portion (170) having an element aperture (210) a pivot aperture (220), a lock aperture (230) and a stopper (240);

a vertical support member (125) that is pivotally connected to said cage hanger (150) via said pivot aperture (220), said vertical support member (125) having a cage hanger pivot aperture (252); and a platform (35) that is supported by four vertical support members (125); said platform (35) having a platform support structure (37) extending downwardly from said platform (35), said platform support structure (37) having a support structure pivot aperture (39), said support structure pivot aperture (39) pivotally receiving a support structure-member fastener therethrough, said cage hanger pivot aperture (250) also pivotally receiving said support structure-member fastener therethrough, said platform support structure (37) having a bar flange (144) extending outwardly therefrom, said bar flange (144) having a vertical support member bar (142) rotatably received therein, said vertical support member bar (142) capable of being connected to at least one of a cable, a cord, a rope, or a spring;

whereby said vertical support bar (142) may be displaced, which causes the vertical support members (125) to pivot about the pivot aperture (220), and retract and deploy the retractable challenge course (10);

whereby said vertical support member (125) can be locked in place after deployment via a pin that is disposed through said locking aperture (230) and said pin also being disposed through a corresponding hole in said vertical support member (125);

whereby said stopper (240) is capable of stopping said vertical support member (125) from extending beyond a desired position.

* * * * *